United States Patent [19]

Suter

[11] Patent Number: 4,587,503

[45] Date of Patent: May 6, 1986

[54] AUXILIARY CONTACT ASSEMBLY FOR MOUNTING ONTO AN ELECTROMAGNETIC SWITCH

[75] Inventor: Heinz Suter, Aarau, Switzerland

[73] Assignee: Sprecher & Schuh AG, Aarau, Switzerland

[21] Appl. No.: 672,112

[22] Filed: Nov. 15, 1984

[30] Foreign Application Priority Data

Nov. 28, 1983 [CH] Switzerland ..... 6339/83

[51] Int. Cl.[4] ..... H01H 51/08

[52] U.S. Cl. ..... 335/135; 335/128

[58] Field of Search ..... 335/128, 135, 129, 131, 335/132, 133, 202, 159, 160, 161, 197, 198

[56] References Cited

FOREIGN PATENT DOCUMENTS 3146780 6/1983 Fed. Rep. of Germany .
422947 4/1967 Switzerland .

*Primary Examiner*—Harold Broome

*Attorney, Agent, or Firm*—Ladas & Parry

[57] ABSTRACT

The auxiliary contact assembly comprises a two part casing having an upper section for receipt of the fixed contacts provided with the connecting screws and a lower section having the shape of a trough open on top and mounted to the upper section by means of locking detents. The fixed contacts are clamped into recesses located in the upper section and open at their sides. A at the bottom open channel is formed at the upper section and acts as guide for the contact bridge carrier. The side walls of the trough-shaped lower section enclose the fixed contacts in the recesses and are provided with narrow projections extending upwards into the area of the connecting screws and form thereby a protection against accidental contact. The contact bridge carrier which is provided with a plurality of contact bridges is guided at the bottom by the lower section of the casing. The lower section is provided with mounting elements and a through hole for the coupling member of the contact bridge carrier.

2 Claims, 6 Drawing Figures

AUXILIARY CONTACT ASSEMBLY FOR MOUNTING ONTO AN ELECTROMAGNETIC SWITCH

BACKGROUND OF THE INVENTION

1. Field of the Invention

The present invention relates to an auxiliary contact assembly for mounting onto an electromagnetic switch apparatus including a casing made of a plastic material and encasing a plurality of fixed contacts which are electrically isolated against each other as well as a contact bridge carrier supporting a plurality of contact bridges.

2. Description of the Prior Art

An auxiliary contact assembly of the kind set forth above is set forth in the Swiss patent specification CH-PS 422 947. According to the disclosure the fixed contacts are interconnectable pairwise by means of contact bridges which are pivotably supported in the casing and equipped each with contact pressure springs. The use of a plurality of contact bridges is detrimental regarding the economical application of such arrangement because a too large number of individual parts is needed.

The German published patent application DE-OS 31 46 780 discloses a multi-contact arrangement for an electromagnetical switch apparatus including a movably guided contact bridge carrier supporting contact bridges which are bent at the center section and supporting the contact bridges by the agency of a spring force and in a window open at the one side. The ends of the contact bridges and the fixed contact parts are surrounded by switch chamber walls arranged rigidly relative to the casing. The contact bridge carrier is formed on a bottom plate which separates the chamber of the electromagnet from the contact chamber of the switch apparatus. The connecting screws of the switch apparatus mounted on the fixed contacts are not performed for protection against accidental contact. Mentioned multi-contact arrangement is designed as upper part of a electromagnetic switch apparatus and acts as main contact arrangement and cannot be used as auxiliary contact arrangement without any further measures.

SUMMARY OF THE INVENTION

It is an object of the present invention to provide a simple and economically advantageous auxiliary contact assembly including a plurality of contact bridges for a electromagnetic switch apparatus which auxiliary contact assembly has connecting screws which are protected against accidental contact.

A further object of the invention is to provide an auxiliary contact assembly in which the casing comprises two sections, the upper section of which comprising laterally open recesses for receipt of the fixed contacts provided with connecting screws and a channel which is open at the bottom and acts as guide of the contact bridge carrier, the lower section of which having a trough-like shape at the top, which trough again has side walls which cover the recesses and the points of contact of the fixed contacts and are provided with narrow projections extending upwards into the area of the connecting screws and forming a protection against accidental contact and the bottom of the trough guiding the contact bridge carrier from below, including mounting members and at least one through opening for a coupling element of the contact bridge carrier.

The upper section comprises preferably a plurality of spring elastically yielding locking detents allowing its mounting to the lower section and engaging into recesses of the lower section.

BRIEF DESCRIPTION OF THE DRAWINGS

The present invention will be more fully understood by reference to the following detailed description thereof, when read in conjunction with the attached drawings, and wherein.

DETAILED DESCRIPTION OF THE PREFERRED EMBODIMENT

Figure 1:
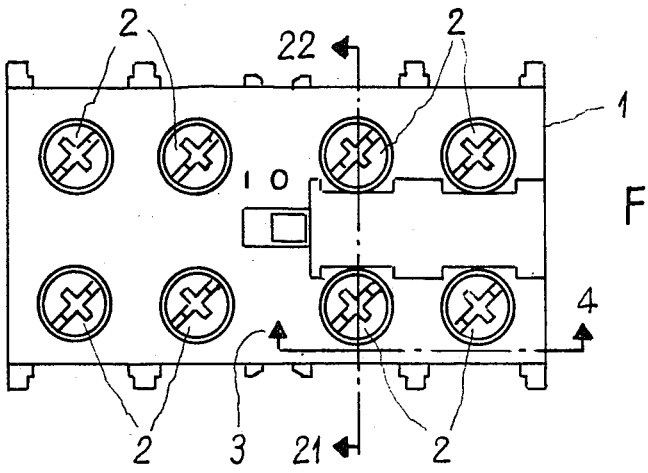
FIG. 1 is a top view of an auxiliary contact assembly.
Figure 2:
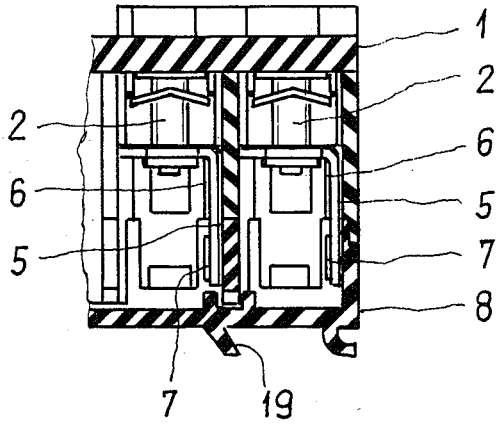
FIG. 2 a view of a section along line 3–4 of FIG. 1.

FIG. 1 illustrates a top view of an auxiliary contact arrangement. The connecting screws 2 of the fixed contact 5 are accessable via through holes provided in the upper section of the casing of the auxiliary contact arrangement which is made of a plastic material. FIG. 2 illustrates the right hand half of the auxiliary contact arrangement shown in FIG. 1, specifically a section along line 3–4 thereof. The longer legs of the L-shaped fixed contacts 5 are pressed into recesses 6 which are open at their sides and are provided in the upper section 1 of the casing. The upper section of the L-shaped fixed contact 5 having the shorter leg receives the connecting screws 2. The point of contact 7 on the fixed contact 5 is located at the lower section thereof. The lower section 8 of the casing has a trough-like shape and closes the auxiliary contact arrangement at the bottom.

Figure 3:
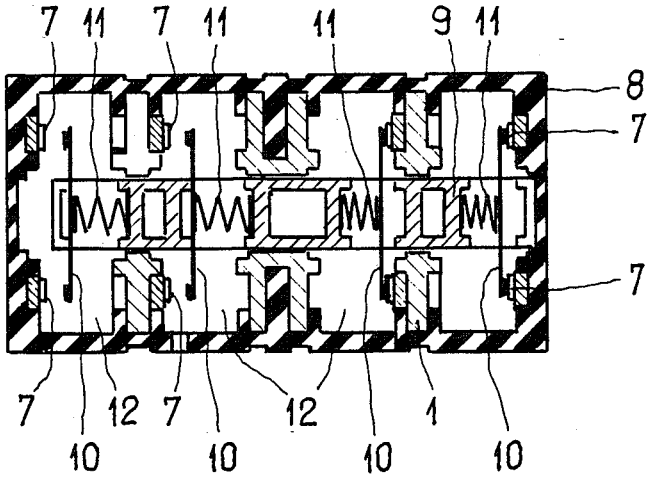
FIG. 3 a view of a longitudinal section of the contact bridge carrier.

FIG. 3 illustrates a longitudinal section of the contact bridge carrier 9. This contact bridge carrier 9 carries a plurality of contact bridges 10 which are acted upon by a contact pressure spring 11. The contact bridge carrier 9 is guided in the upper section 1 of the casing. The side walls of the lower section 8 of the casing do not only cover the recesses 6 illustrated only in FIG. 2 including the contacts 5 inserted therein, but also the points of contact 7 of the fixed contacts 5 and close the contact chamber 12 off against the outside.

Figure 4:
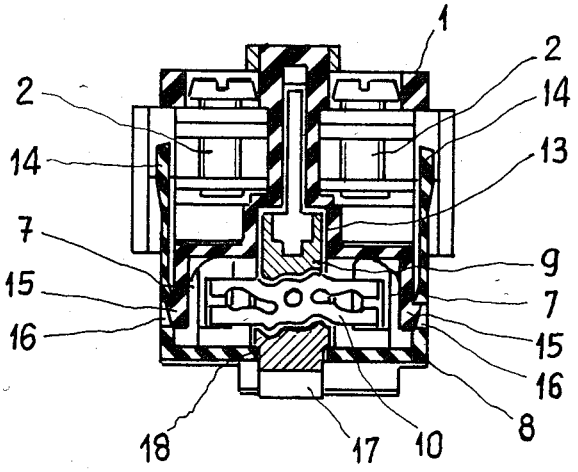
FIG. 4 a view of a section along line 21–22 of FIG. 1.
Figure 5:
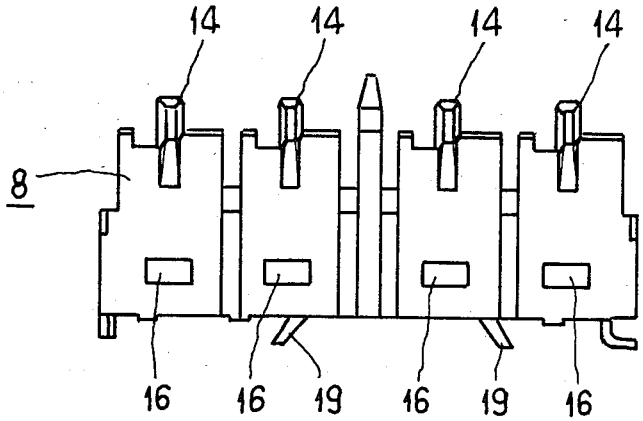
FIG. 5 a side view.

FIG. 4 illustrates a view of a section along line 21–22 of FIG. 1. FIG. 4 illustrates specifically clear channel 13 which is open at the bottom and provided in the upper section 1 of the casing. The contact bridge carrier 9 is guided on the top and laterally in this channel 13. At the bottom the contact bridge carrier 9 is guided by the floor of the lower section 8 of the casing. The side walls of the lower section 8 are provided with narrow projections 14 extending upwards into the area of the connecting screws 2. These projections 14 are most clearly seen in FIG. 5 and act as a protection against an accidental lateral contact. Due to this protection against accidental contact the fingertip of at least grown-up human beings cannot be brought anymore laterally from the outside into contact with the connecting screw 2 being under current.

Spring elastically yielding locking detents 15 are integrally formed at the upper section 1 which locking detents 15 engage into recesses 16 formed in the lower section. This secures an extremly simple assembling of the casing.

Figure 6:
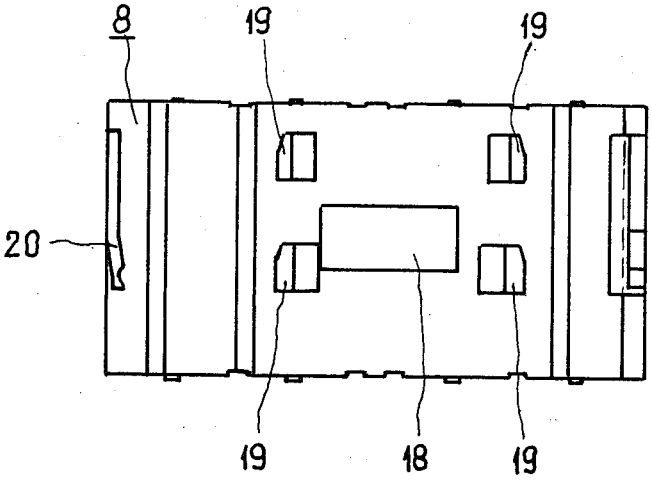
FIG. 6 a view from below of the lower section of the casing.

A through opening 18 (FIG. 6) provided at the bottom floor of the lower section 8 of the casing is provided for the coupling member 17 of the contact bridge carrier 9. By the agency of this coupling member 17 the contact bridge carrier 9 can be operatively connected to the movable parts of an electromagnetic switch apparatus. The dogs 19 formed integrally at the bottom of the lower section 8 serve as mounting members by means of which the auxiliary contact arrangement is mounted to an electromagnetic switch apparatus during assembly. In the assembled state these dogs 19 provide a form locked connection by gripping under corresponding shaped counter pieces provided at the switch apparatus. Such mounting can be secured by means of the locking spring 20 interacting with a locking nose provided at the switch apparatus.

While there is shown and described a present preferred embodiment of the invention, it is to be distinctly understood that the invention is not limited thereto, but may be otherwise variously embodied and practiced within the scope of the followings claims.

I claim:

1. An auxiliary contact assembly for mounting onto an electromagnetic switch apparatus including a casing made of a plastic material and encasing a plurality of fixed contacts which are electrically isolated against each other as well as a contact bridge carrier supporting a plurality of contact bridges, in which the casing comprises two sections, the upper section of which comprising laterally open recesses for receipt of the fixed contacts provided with connecting screws and a channel which is open at the bottom and acting as guide of the contact bridge carrier, the lower section of which having a trough-like shape open at the top, which trough has side walls which cover the recesses and points of contact of the fixed ontacts and are provided with narrow projections extending upwards in to the area of the connecting screws and forming a protection against accidental lateral contact and the bottom of the trough guiding the contact bridge carrier from below, including mounting members and at least one through opening for a coupling element of the contact bridge carrier.

2. The auxiliary contact assembly of claim 1, in which the upper section comprises a plurality of spring elastically yielding locking detents allowing its mounting to the lower section and engaging into recesses of the lower section.

* * * * *